United States Patent [19]

Jones

[11] Patent Number: 4,679,239

[45] Date of Patent: Jul. 7, 1987

[54] APPARATUS AND METHOD FOR PROCESSING STEREO SIGNALS FOR APPLICATION TO AN AM STEREO BROADCASTING UNIT

[75] Inventor: Ronald R. Jones, Phoenix, Ariz.

[73] Assignee: National Communications Research Center, Inc., Tempe, Ariz.

[21] Appl. No.: 643,071

[22] Filed: Aug. 22, 1984

[51] Int. Cl.[4] ..... H04H 5/00

[52] U.S. Cl. ..... 381/16

[58] Field of Search ..... 381/15, 16, 103, 106, 381/1, 4, 14; 332/23 A

[56] References Cited

U.S. PATENT DOCUMENTS

| | | | |
|---|---|---|---|
| 3,732,375 | 5/1973 | Kuribayashi | 381/16 |
| 4,359,601 | 11/1982 | England | 381/103 |
| 4,486,898 | 12/1984 | Yokoya | 381/16 |
| 4,535,471 | 8/1985 | Kuroda | 381/106 |

*Primary Examiner*—Forester W. Isen

*Attorney, Agent, or Firm*—Harry M. Weiss & Associates

[57] ABSTRACT

In a system for processing stereo signals prior to application to an AM stereo channel information, the signals prior to broadcasting left channel and right channel automatic gain controllers are specially (L+R) gain controlled to maintain monaural loudness and are then followed by a low and high frequency equalizer and filter network. The system next transforms the audio into (L+R) and (L−R) signals and uses a multiband (L+R) and (L−R) peak limiting and clipping system with a variable gain (L−R) "stereo enhancement" amplifier located in the (L−R) path. The (L+R) and (L−R) audio is then applied to final peak clipping bandwidth filters. Finally, the (L+R) and (L−R) audio is transformed back into left and right audio which undergo left and right negative AGC'ing and peak clipping for decoding compatibility.

3 Claims, 5 Drawing Figures

APPARATUS AND METHOD FOR PROCESSING STEREO SIGNALS FOR APPLICATION TO AN AM STEREO BROADCASTING UNIT

BACKGROUND OF THE INVENTION

1. Field of the Invention

This invention relates generally to processing of amplitude modulated (AM) signals and more particularly to the processing of AM signals prior to application of the signals to a broadcast unit in order to improve the quality of the stereophonic sound reproduced at the receiving apparatus.

2. Description of Related Art

In the broadcast of amplitude modulated (AM) stereo signals, government regulations require that the broadcast transmission be comprised of a carrier amplitude modulation which is encoded with the sum of the left channel stereo signal and the right channel stereo signal, the carrier further having phase modulation which is encoded with the difference between the left channel stereo signal and the right channel stereo signals. To the extent possible, it is desirable that the left channel stereo signal have 100% amplitude when that signal alone is processed by the receiving apparatus, that the right channel stereo signal have 100% amplitude when the right detection signal is processed by the receiving apparatus, and that both signals have 100% amplitude when processed by the receiving apparatus (monaural) operation.

In a conventional left and right limiting signal pattern, shown in FIG. 1*a*, the sum of the left channel stereo signal and right channel stereo signal (L+R) signal represents the main monaural component at the broadcast transmitter. The difference between the left channel stereo signal and the right channel stereo signal (L−R) represents the stereophonic information to be transmitted.

Referring once again to FIG. 1*a*, when the input signal from a stereo unit shifts to full right channel signal or to full left channel signal, the L+R modulation component is forced to drop 50% as shown by the dotted line, and thus the monaural component drops by 50% (6 db). Although the stereo reproduction is not affected, the monaural reproduction is deemed to be unacceptable.

To reduce the effect of full right channel or full left channel communication, full matrix limiting has been utlilzed and is shown in FIG. 1*b*. With this system the output signal levels of the L+R and L−R are adjusted for equal modulation, which is the point of maximum separation. As shown, the amplitude limit levels are perpendicular to the L+R and L−R signals and intersect at the left signal and right signal axis. When the stereo inputs temporarily shift to full right channel or full left channel modulation, the limit levels permit the L+R signal component to remain at 100% modulation, which maintains full monaural reception compatibility. The shaded areas shown in FIG. 1*b* illustrate the increased monaural support modudlation as compared to earlier systems. However, further analysis demonstrates that stereo reception will have a 50% (6 db) increase in signal channel receptions. While this change has been shown to be more acceptable to listeners than the equivalent change in monaural reception, a need was felt for a system that provided a more accurate transmission of the stereo signals.

SUMMARY

It is therefore an object of this invention to provide an improved system for transmitting AM stereo information.

It is another object of the present invention to provide a system for transmitting AM stereo signals that does not result in a large change in the monaural signal when full single channel stereo operation is achieved.

It is yet another object of the present invention to provide a AM broadcast system for transmitting stereo signals, a system that does not result in a large change in one of the receiver stereo channel signals when the full stereo signal is applied to only one of the channels.

It is still another object of the present invention to provide an improved system for broadcasting AM stereo system that utilizes a modified matrix processing procedure.

It is still a further object of the present invention to provide a system for use with an AM broadcast facility that reduces overloads in present stereo decoding and reception techniques under heavy or extreme levels of audio processing.

It is yet a further object of the present invention to provide an AM stereo broadcasting system that allows full monaural compatability during most stereo conditions, but a reduction of the L−R and the negative L+R modulation during left channel only or right channel only stereo conditions.

The aforementioned and other objects are accomplished, according to the present invention, by a system for broadcasting AM stereophonic audio information that proccesses the left and right stereo channel signals prior to application of left and right stereo channel signals to the AM stereo exciter and transmitters. The processing of these signals includes input apparatus for elimination of common mode hum and other noise; AGC/compressor input devices for separate control of the left channel and right channel signals by a combined L+R signal, a combined high frequency pass and bass frequency boost filter and pre-emphasis equalizer, a variable gain stereo enhance feature in the L−R path, L+R signal path having a clipping priority and a L−R signal path having AGC priority, and a single channel left and right negative peak limiting circuit for reduced received decoder distortion.

These and other features of the invention will be understood upon reading of the specification along with the drawings.

DESCRIPTION OF THE PREFERRED EMBODIMENT

Detailed Description of the Drawing

Figure 1A:
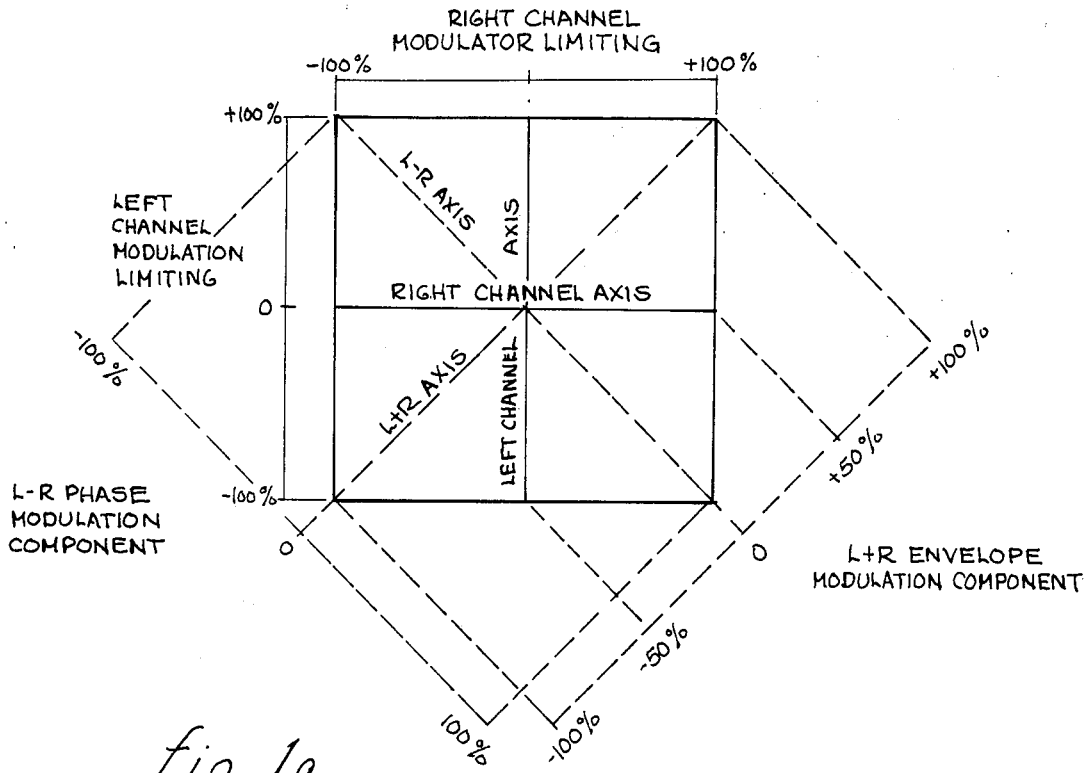
FIG. 1*a* is a diagram illustrating the combination of left channel and right channel stereo singals into L−R and L+R signals.

Referring first to FIG. 1*a*, a diagram of the combination of left channel and right channel stereo signals to produce the L+R and L−R signals is shown. The right channel stereo modulation (R) is shown along the X-axis while the left channel stereo modulation (L) is shown along the Y-axis. The L−R channel stereo modulation and the L+R stereo channel modulation are shown as diagonal lines. The dotted lines indicate the L+R envelope modulation component and the L−R envelope component.

Figure 1B:
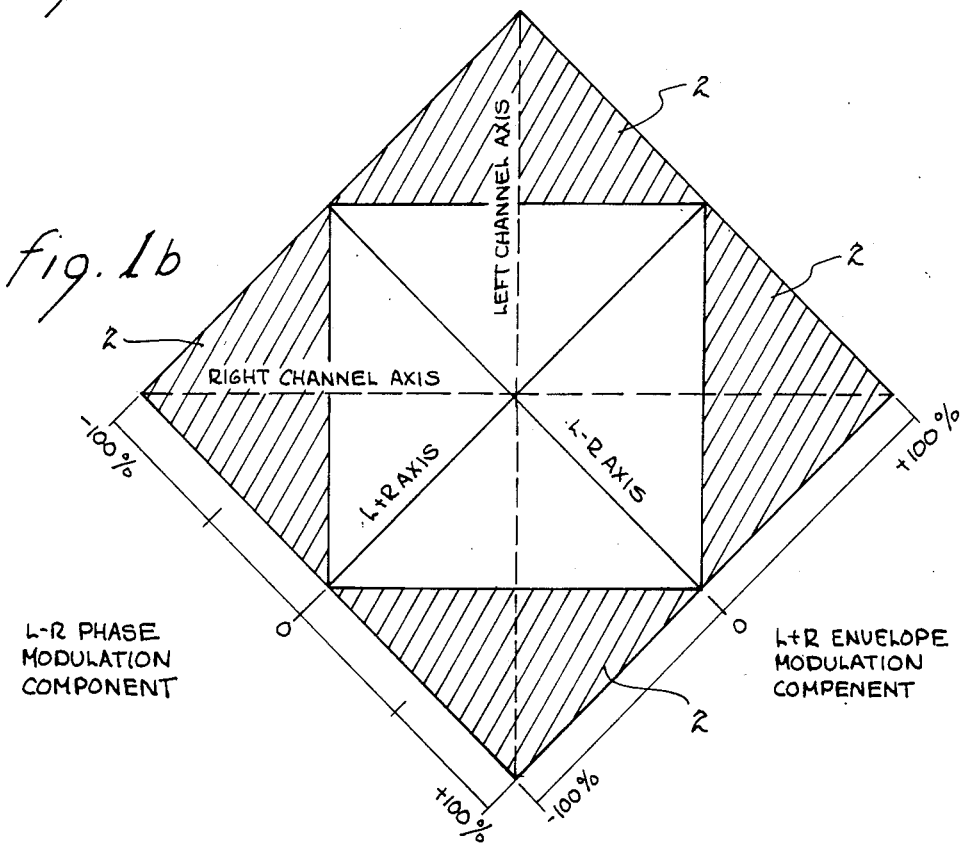
FIG. 1*b* is a diagram illustrating the full matrix limiting method for combining the left channel and right channel stereo signals into L−R and L+R signals.

Referring to FIG. 1*b*, a procedure for improving an AM stereo broadcast system is shown. Once again the right (R) channel stereo signal is illustrated as being along the X-axis and the left (L) channel stereo signal is illustrated as being along the Y-axis. The L+R envelope modulation component and the L−R phase modulation component are illustrated as being along the diagonals formed by the left and right stereo channel signals. The shaded areas 2 of the diagram indicate the increased areas of monaural support. These areas permit full monaural reception for single channel only signals.

Figure 1C:
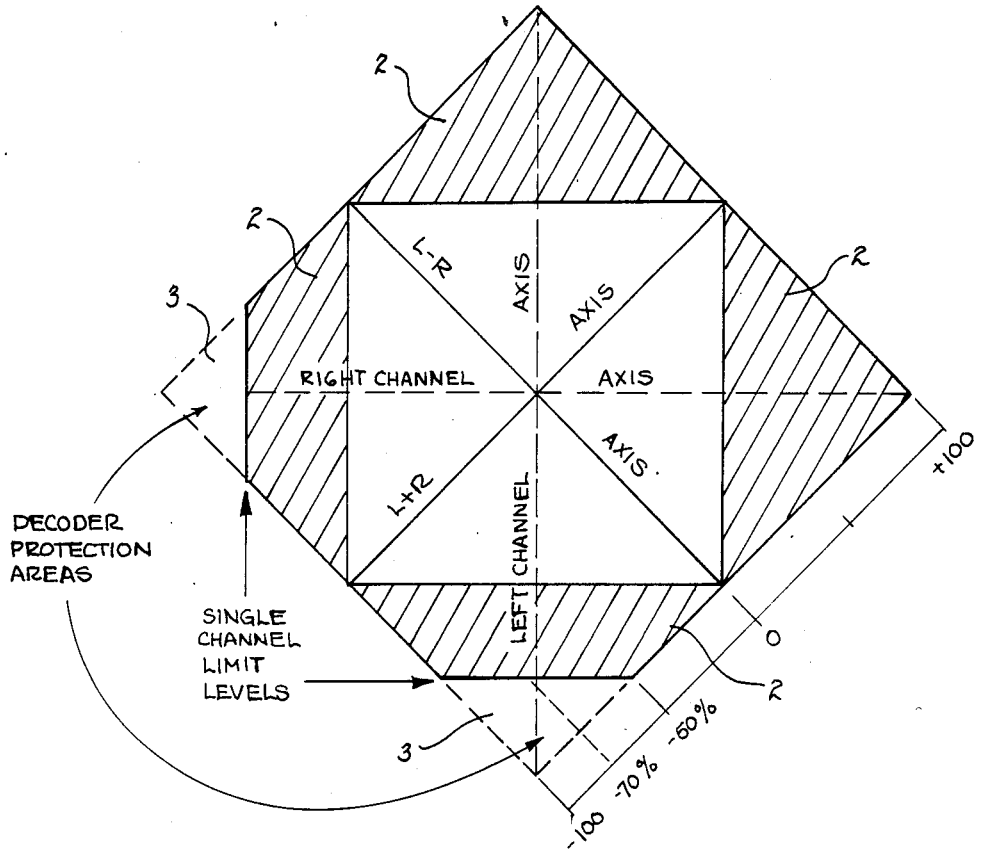
FIG. 1*c* is a diagram illustrating the modified matrix limiting method for combining the left channel and right channel stereo signals into L−R and L+R signals.

Referring to FIG. 1*c*, the modified matrix limiting procedure for providing an increased compatibility between monaural and stereophonic reception is illustrated. The left channel and right channel signals are arranged as shown in the previous figures. The negative left channel limiting and negative right channel limiting are shown and the decoder protection areas 3 are illustrated.

Figure 2:
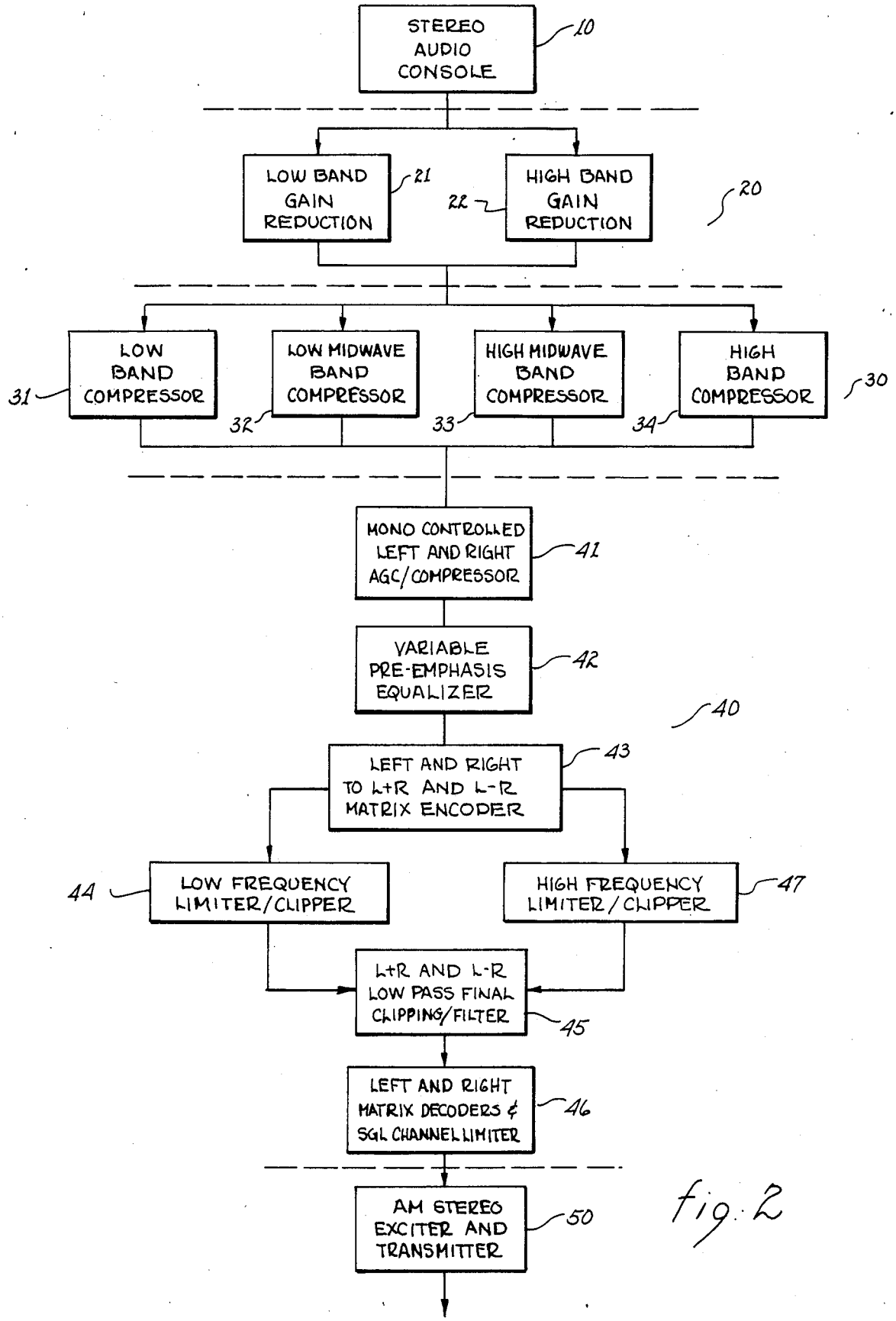
FIG. 2 is a block diagram of an AM stereo broadcast system.

Referring now to FIG. 2, the stereo audio console 10 is coupled to low band gain reduction device 21 and high band gain reduction device 22. The low band gain reduction device 21 and the high band gain reduction device 22 are coupled to low band compressor device 31, low midrange band compressor device 32, high midrange band compressor device 33 and high band compressor device 34. The low band compressor device 31, low midrange band compressor device 32, high midrange bnad compressor device 33 and high band compressor device 34 are coupled to mono controlled left and right AGC/compressor device 41 where AGC refers to automatic gain control. The mono controlled left and right AGC/compressor device 41 is coupled to the variable pre-emphasis equalizer device 42. The variable pre-emphasis equalizer device 42 is coupled to the left and right to L+R and L−R matrix encoder device 43. The left and right to L+R and L−R matrix encoder device 43 is coupled to the low frequency limiter/clipper 44 and high frequency limiter clipper device 47. The low frequency limiter/clipper device 44 and high frequency limiter/clipper device 47 are coupled to L+R and L−R low pass final limiting/filter device 45. The L+R and L−R low pass final clipping/filter device 45 is coupled to the left and right matrix decoder and single (SGL) channel limiter device 46. The left and right matrix decoder and SGL channel limiter device 46 is coupled to the AM stereo exciter and transmitter device 50.

Figure 3:
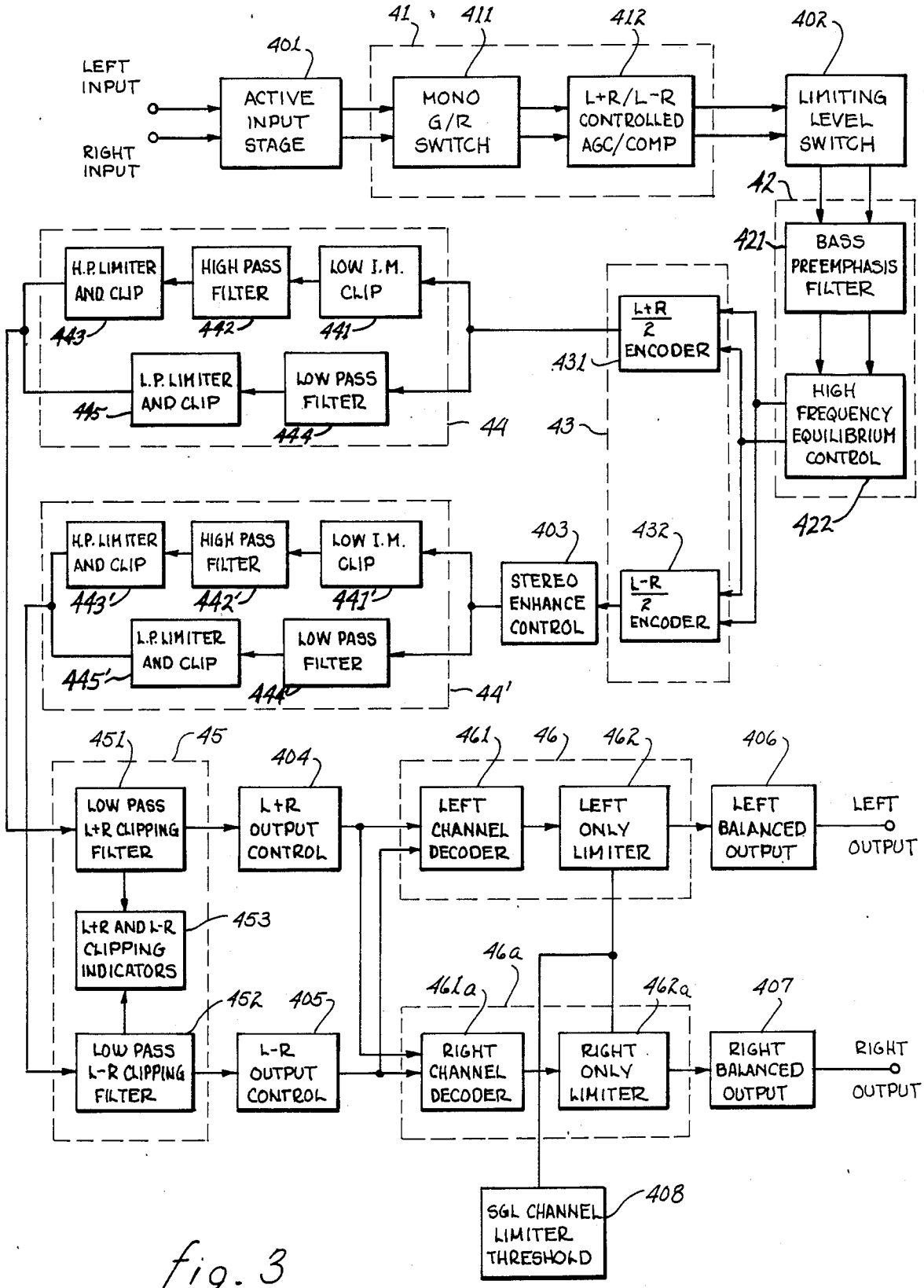
FIG. 3 is a block diagram of the apparatus for processing the left channel and right channel stereo signals prior to application to the AM stereo exciter and transmitter unit in an Am stereo broadcast unit.

Referring to FIG. 3, the elements comprising the group of elements labelled 40 in FIG. 2 are shown in detail. Left channel input and right channel input signals are coupled to active input stage 401. Active input stage 401 is coupled to mono gain reduction (G/R) switch 411, which in turn is coupled to (L+R) and (L−R) controlled AGC/compressor circuit 412. Mono G/R switch 410 and (L+R) and (L−R) controlled AGC/compressor circuit 412 are components of mono controlled left and right AGC/compressor device 41 of FIG. 2. (L+R) and (L−R) controlled AGC/compressor 412 is coupled to limiting level switch 402 which is in turn coupled to bass pre-emphasis filter circuit 421. Bass pre-emphasis filter circuit 421 is coupled to high frequency equilibrium contol circuit 422. Bass pre-emphasis filter 421 and high frequency equilibrium control circuit 422 are components of variable pre-emphasis equalizer device 42 of FIG. 2. High frequency equilibrium control circuit 422 is coupled to (L+R)/2 encoder circuit 431 and (L−R)/2 encoder circuit 432. (L+R)/2 encoder circuit 431 and (L−R)/2 encoder circuit 432 are components of left channel stereo signal and right channel stereo signal to (L+R) and (L−R) matrix encoder device 43 of FIG. 2. (L−R)/2 encoder circuit 432 is coupled to stereo enhance control circuit 403. (L+R)/2 encoder circuit is coupled through low pass filter circuit 444 to low pass (L.P.) limiter and clipping circuit 445 and through low intermediate (I.M.) clip circuit 441 to high pass filter circuit 442. L.P. limiter and clipping circuit 445 is coupled to low pass L+R clipping filter circuit 451 and high pass filter circuit 442 is coupled through high pass (H.P.) limiter and clipping circuit 443 to low pass (L+R) clipping filter circuit 451. Stereo enhance control circuit 403 is coupled through low I.M. clipping circuit 441 to high pass filter circuit 442 and through low pass filter circuit 444' to L.P. limiter and clipping circuit 445'. L.P. limiter and clipping circuit 445' is coupled to low pass (L+R) clipping filter circuit 452' and high pass filter circuit 442' is coupled through H.P. limiter and clipping circuit 452'. Low I.M. clipping circuit 441, high pass filter circuit 442 and H.P. limiter and clipping circuit 443 and low I.M. clipping circuit 441', high pass filter circuit 442' and H.P. limiter and clipping circuit 443' are components of high frequency limiter/clipper device 47 of FIG. 2. Low pass filter circuit 444 and L.P. limiter and clipping circuit 445 and low pass filter circuit 444' and L.P. limiter and clipping circuit 445' are components of low frequency limiter/clipper device 44. Low pass (L+R) clipping filter circuit 451 is coupled to L+R output control circuit 404 and (L+R) and (L−R) clipping indicators 453 and low pass (L−R) clipping filter circuit 452 is coupled to (L−R) output control circuit 405 and (L+R) and (L−R) clipping indicators 453. Low pass (L+R) clipping filter circuit 451, (L+R) and (L−R) clipping indicators 453, and low pass L−R clipping filter circuit 452 are components of the (L+R) and (L−R) low pass final clipping and filter circuit 45. (L+R) output control circuit 404 is coupled through left channel decoder circuit 461 to left only limiter circuit 462 and through right channel decoder circuit 461*a* to the right only limited circuit 462*a*. (L−R) output control circuit 405 is coupled through left channel decoder circuit 461 to left channel only limiter circuit 462 and through right channel decoder circuit 461*a* to right channel only limiter circuit 462*a*. SGL channel limiter threshold circuit 463 is coupled to left channel only limiter circuit 462 and right channel only limiter circuit 462*a*. Left channel decoder circuit 461, left channel only decoder circuit 462, right channel decoder circuit 461*a*, right channel only limiter circuit 462*a* and SGL channel limiter threshold circuit 463 are components of left channel and right channel matrix decoder and SGL channel limiter device 46. Left only limiter circuit 462 is coupled to left channel balanced output circuit 406, the output signal of circuit 406 is the left channel output signal. The right only limiter circuit 462*a* is coupled to right balanced output circuit 407, the output signal of circuit 407 being the right channel output signal.

Operation of the Preferred Embodiment

The procedure for the broadcast of amplitude modulated stereo broadcast signals has been defined as an amplitude modulation of the carrier signal resulting from the sum of the right channel stereo signal plus the left channel stereo signal. The broadcast carrier signal is phase modulated with the left channel stereo signal minus the right channel stereo signal. Any processing of the signal must occur prior to the application of the right channel and left channel stereo signal to the AM stereo exciter and transmitter 50.

The signals from the stereo audio console 10 applied to stage 20 and stage 30. Stage 20 has active balanced audio input configurations that are adapted to eliminate common mode hum interference, and other forms of audio distortion. These signal processing stages are balanced against ground ard are formed by active differential input amplifiers. The differential amplifiers are radio frequency filtering networks. Stage 30 provides for specialized gain control that is not important to the instant invention.

In the instant invention, the stereophonic audio signal begins for monaural (L+R) compatibility while the information is still in left channel and right channel signals. The left and right channel signals are gain controlled by input AGC/compressor circuit, 412. These stages employ a single feedback control loop and are controlled by a gain adjusting signal. The gain adjusting signal is derived, after matrix combination of the left channel and right channel stereo signal in the left and right matrix encoder device 43 from the logical OR function performed on the (L+R) signal and the (L−R) signal. The control loop can be a feed forward circuit as long as the associated gain control elements have a linear functionality. The (L+R) and (L−R) controlled AGC/compressor circuit 412 maintains a constant average amplitude output level for the summation of the left and right channel stereo signals. In the instant invention, the average amplitude level of the summation of both signals is maintained by doubling the amplitude of either audio signal channel whenever the opposite stereo channel signal falls to zero. This feature is in contradistinction to conventional compressors which maintain a constant average amplitude level for left channel and right channel stereo output signals separately.

Another technique for AM stereo processing achieves this result by first transforming the left and right stereo audio signals into (L+R) and (L−R) signals and then using gain control techniques on those signals. The advantages of the method of the instant invention over such techniques are that no degradation of the audio separation can occur at this point as a result of gain control element mistracking or gain-phase errors in the processing paths and no unnatural sounding "L−R build-up" results because of the over amplification of the L−R signal as compared to the L+R signal information which undergoes identical processing in their separate paths.

An additional feature for the input compressor circuits of the instant invention is achieved through the modification of the previously patented design, "Voltage Controlled Resistor", U.S. Pat. No. 4,393,346 assigned to the assignee of the instant invention. Output coupling re-arrangement allows the gain reduction element to be frequency dependent and affects primarily mid and high audio frequencies. This coupling reduces the effect of high amplitude low frequency bass from audibly gain intermodulating the mid and higher audio frequencies. Usually, this ability has been associated only with paralled multiband gain control processing systems which were especially designed to handle such problems.

Referring to variable pre-emphasis equalizer 42, the stereo left and right channel signals undergo low and high frequency equalization for bandwidth limiting and transmission fidelity improvement. This processing is accomplished on the left and right channel signal domain in order to eliminate separation degradations which would be caused by the equalizer gain and phase errors when the processing is performed in the L+R and L−R signal domain.

Low frequency equlization is used to cut off frequencies below 80 hertz and provides several transmission benefits for AM stereo broadcasting. First, the equalization is used to reduce the excessive transmitter peak power requirements which are caused by high amplitude modulation levels at very low audio frequencies. Second, the equalization is used for bandwidth limiting to reduce the transmission of very low (L−R) frequencies which can interfere with receptions and resultant detection of the stereo transmission pilot frequencies. The high pass filter used for this reduction is a multipole filter which is uniquely designed to have a ripple that maximizes the suppression of frequencies below 80 hertz and 5 hertz and at the same time boosts the low frequencies above 80 hertz by causing a peak around 100 hertz to create the illusion of an audible increase of low frequency audio.

High frequency equalization in equalizer 42 is used to compensate for receiver intermediate frequency (I.F.) roll-off and has been used by the industry for several years. Two primary methods have been used by various inventors of audio processing products. Pre-emphasis is placed at one point, usually in front of a large number of parallel multiband limiter (or compressor) stages or in front of the final output clipping (or limiting) stages. When placed in front of large multiband limiters or compressors, single point pre-emphasis tends to cause amplification and enhancement of high frequency noise floors. When placed prior to final output clipping or limiting, excessive inter-modulation and harmonic distortions are often generated.

The present invention uses a pre-emphasis network that is distributed in smaller sequential parts among numerous gain control stages. This distribution reduces the above mentioned problems of having to control a large amount of pre-emphasis boosting at a single control point. The system invention places a first order fixed boost shelving equalizer used for the lower frequency portion of the total pre-emphasis curve and is located within the prior described left and right AGC loops. Next, a variable break point first order equalizer which forms the middle portion of the total curve is placed prior to the following multiband limiting and clipping stages. Finally, the remaining portion of the pre-emphasis curve is located within the final output clipping filter to be described below.

In left channel and right channel stereo signal to L+R and L−R encoder device 43, and left and right channel audio signals are transformed into (L+R) and (L−R) signals so that final peak limiting and clipping can be applied to the audio signals while this signal is domain. This procedure is considered necessary because AM stereo broadcasts are transmitted as (L+R) and (L−R) signals and not left and right signals. The L+R and L−R signals are formed by summation and differential amplifiers respectively.

Stereo enhance control circuit 403 is a variable gain amplifier with range from 1 to 2 and is placed in the (L−R) path just prior to the (L−R) multiband peak limiting and clipping stages. Control circuit 403 is placed in this position in order to increase or "enhance" the audible stereophonic effect of the transmitted stereo signal. Because only small amounts of gain control action is produced beyond this point, the stereo effect can be pleasingly enhanced without the danger of being overly enhanced (as can happen when there is too much gain control action in the (L−R) path). This effect is why other existing AM stereo audio processing systems which rely on large amounts of AGC'ing, compression and limiting of the L+R and L−R channels after transformation from left and right audio signals can produce the "L−R build-up" problem.

The (L+R) and (L−R) signals are each separated into low and high frequency components, applied to limiter clipper circuits 44 and 44' where the two channel signals are independently limited and clipped, and then re-combined back into (L+R) and (L−R) signals.

A major difference between the instant invention and earlier techniques exists at this point. While the use of multiband limiting and clipping is a known technique, processing of the audio signals in the (L+R) and (L−R) paths with different characteristics is unique. Existing (L+R) and (L−R) matrix processing techniques have utilized the treatment of the (L+R) and (L−R) components as identical in an effort to maintain instantaneous separation integrity under high levels of gain control action. While the system invention does use identical gain and phase paths (excluding the (L−R) stereo enhance amplifier) for (L+R) and (L−R), limiting and clipping actions by limiter clipper circuits 44 and 44' respectively do not treat the (L+R) and (L−R) components identically.

The (L+R) path has more of a clipping function than a limiting function as its audio processing priority. This is used to maintain competitive loudness with existing AM monaural processing technologies but at the sacrifice of quality and higher distortion levels.

The (L−R) path has more of a limiting function than a clipping function as its priority, in order to maintain low distortion and to eliminate excessive densities of the difference information ("L−R build-up"), in the stereophonic information that exists in this path.

The major advantage of this configuration is in its improvement of broadcasting compatibility between AM monaural and stereo transmission requirements. While higher distortion levels than normal have to be tolerated in the (L+R) signal in order to satisfy competitive monaural transmission requirements, the lowering of distortion levels in the (L−R) signal through different processing characteristics helps to reduce the received distortions received in stereo. The distortion level in decoded stereo transmissions can theoretically be reduced to one half that of the monaural distortion during high stereo signal transmissions. This reduction results because one half of left only and right only transmissions are formed from the L+R signal and the other one half is formed from the L−R signal. Under these conditions, the mathematical expression for signal channels can be demonstrated by the following expression; left channel decoded=(L+R+thd)+(L−R)=(2L+thd). Thus, the relative to the level of the channel after decoding, the resultant distortion is effectively one half that of the L+R level.

The high frequency components of the L+R and L−R signals are separated by high pass filtering such that they contain the majority of the pre-emphasized audio spectrum. These components are then specially processed to maintain maximum high frequency density and yet produce a minimum of inter-modulation and harmonic distortions. The low frequency components are separated by low pass filtering and are gain controlled with average AGC limiting and frequency selective peak clipping. This technique allows low frequency bass audio to pass through relatively unprocessed, while the higher frequency spectrum of the low frequency band is processed.

After the high and low frequency components are re-combined by summation amplifiers, the reconstructed L+R and L−R signals are passed through two identical low pass clipping filters 451 and 452 respectively which are derived from a previously patented design, "Resonant Filtered Clipper", U.S. Pat. No. 4,383,229 assigned to the assignee of this Patent Application. These clipping filters provide the final L+R and L−R limit levels prior to AM stereo transmission and also remove very high frequency audio components caused by prior audio pre-emphasis as well as by previous audio clipping.

In left and right matrix decoders and SGL channel limiter device 46, the processed L+R and L−R audio signals are next transformed back into left and right channel audio signals for left and right negative peak limiting circuits, i.e 462 and **462*a*** respectively, prior to leaving the system invention. The left and right audio signals are formed by summation and differential amplifiers respectively. Specially designed combination average signal limiting and negative peak clipping gain control circuits are used to limit the negative peak waveforms of the decoded left and right channel processed audio. The limit threshold is adjustable from no limiting to as much as 60% of the negative peak amplitude level of the previously limited and clipped (L+R) and (L−R) levels. This is necessary in order to relieve certain types of decoder distortions which can result when excessive single channel modulation levels in the negative direction occur. Commercial decoders, used for AM stereo decoding, can cause distortions for single channel modulations with negative peaks exceeding 65% to 70%. The instant system allows full monaural compatibility during most stereo conditions, but causes a reduction of L−R and negative peak (L+R) modulation levels during left only or right only stereo conditions.

In left balanced output circuit 406 and right balanced output circuit 407, the left and right channel processed audio signals are finally connected externally from the system invention through an active balanced audio output configuration, thereby eliminating common mode hum and other forms of noise and interference. These stages are balanced against ground and are formed by active push pull output amplifiers followed by RFI output filtering techniques.

The above description is included to illustrate the operation of the preferred embodiment and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. In a system for processing signals from an audio source, left channel stereo signals and right channel stereo signals for application to an AM stereo exciter and transmitter unit, signal processing apparatus comprising:

AGC/compressor means coupled to said audio source for gain control;

filter/equalizer means coupled to said AGC/compressor means for passing high freqencies and for boosting bass frequencies;

encoding means coupled to said filter equalizer means for encoding said left and said right channel signals into a left plus right signal and a left minus right signal, said left plus right signal controlling said AGC/compressor means;

means for enhancing said left minus right signal;

means for processing said left plus right signal;

means for processing said left minus right signal;

decoding means for developing a left channel signal, and a right channel signal, for said processed left minus right signal and said left plus right signal; and limiting means for limiting a negative peak signal of said processed left and said processed right signal.

2. The signal processing apparatus of claim 1 further including active input means coupled between said audio and said AGC/compressor means for reducing common mode hum.

3. The signal processing apparatus of claim 1 or 2 wherein said means for processing said left plus right signal has clipping rather than limiting as a first priority, and said means for processing said left minus right signal has limiting as a first priority.

* * * * *